US007997934B2

(12) United States Patent
Bixler et al.

(10) Patent No.: US 7,997,934 B2
(45) **Date of Patent: *Aug. 16, 2011**

(54) CONNECTOR WITH INSERT FOR REDUCED CROSSTALK

(75) Inventors: Craig A. Bixler, Elmhurst, IL (US); John C. Laurx, Aurora, IL (US); Neil A. Martin, Naperville, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/875,580

(22) Filed: Sep. 3, 2010

(65) Prior Publication Data

US 2010/0330840 A1 Dec. 30, 2010

Related U.S. Application Data

(63) Continuation of application No. 12/535,102, filed on Aug. 4, 2009, now Pat. No. 7,811,134, which is a continuation of application No. 11/771,666, filed on Jun. 29, 2007, now Pat. No. 7,632,149.

(60) Provisional application No. 60/817,857, filed on Jun. 30, 2006, provisional application No. 60/818,140, filed on Jun. 30, 2006.

(51) Int. Cl.
*H01R 13/648* (2006.01)

(52) U.S. Cl. ..... 439/608

(58) Field of Classification Search ..... 439/608
See application file for complete search history.

(56) References Cited

U.S. PATENT DOCUMENTS

| | | | | |
|---|---|---|---|---|
| 5,066,236 | A | 11/1991 | Broeksteeg | |
| 5,104,341 | A | 4/1992 | Gilissen et al. | |
| 5,201,855 | A | 4/1993 | Ikola | |
| 5,860,816 | A | 1/1999 | Provencher et al. | |
| 6,231,391 | B1 | 5/2001 | Ramey et al. | |
| 6,293,827 | B1 | 9/2001 | Stokoe | |
| 6,409,543 | B1 | 6/2002 | Astbury, Jr. et al. | |
| 6,506,076 | B2 | 1/2003 | Cohen et al. | |
| 6,602,095 | B2 | 8/2003 | Astbury, Jr. et al. | |
| 6,709,294 | B1 | 3/2004 | Cohen et al. | |
| 6,776,659 | B1 | 8/2004 | Stokoe et al. | |
| 6,780,059 | B1 | 8/2004 | Payne et al. | |
| 6,786,771 | B2 | 9/2004 | Gailus | |
| 6,803,650 | B2 * | 10/2004 | Crane et al. | 257/697 |
| 6,808,399 | B2 | 10/2004 | Rothermel et al. | |
| 6,814,619 | B1 | 11/2004 | Stokoe et al. | |
| 6,872,085 | B1 | 3/2005 | Cohen et al. | |
| 6,971,916 | B2 | 12/2005 | Tokunaga | |
| 7,074,086 | B2 | 7/2006 | Cohen et al. | |
| 7,094,102 | B2 | 8/2006 | Cohen et al. | |
| 7,108,556 | B2 | 9/2006 | Cohen et al. | |
| 7,163,421 | B1 | 1/2007 | Cohen et al. | |
| 7,311,532 | B1 | 12/2007 | Bippus et al. | |
| 7,563,106 | B2 | 7/2009 | Lin et al. | |
| 7,762,847 | B2 | 7/2010 | Feldman et al. | |
| 2002/0111069 | A1 | 8/2002 | Astbury, Jr. et al. | |

(Continued)

*Primary Examiner* — Truc T Nguyen
(74) *Attorney, Agent, or Firm* — Stephen L. Sheldon

(57) ABSTRACT

A differential pair connector has a housing floor, an array of differential pairs passing through the housing floor, and a conductive grid integrated into the housing floor for reducing crosstalk between the differential pairs. The conductive grid can have various structures, such as conductive inserts, plated regions and/or a conductive housing floor surrounding non-conductive inserts protecting the differential pins. Although any suitable means can be used to fasten the conductive grid into the housing floor, the grid is preferably press fitted into the top of the housing floor.

9 Claims, 14 Drawing Sheets

U.S. PATENT DOCUMENTS

2004/0264153 A1 12/2004 Payne et al.
2006/0068640 A1 3/2006 Gailus
2006/0276081 A1 12/2006 Cohen et al.
2007/0004282 A1 1/2007 Cohen et al.
2007/0042639 A1 2/2007 Manter et al.
2007/0054554 A1 3/2007 Do et al.

* cited by examiner

CONNECTOR WITH INSERT FOR REDUCED CROSSTALK

CROSS REFERENCE TO RELATED APPLICATIONS

This patent application is a continuation of U.S. Serial application Ser. No. 12/535,102, filed Aug. 4, 2009, now U.S. Pat. No. 7,811,134, which in turn is a continuation of U.S. application Ser. No. 11/771,666, filed Jun. 29, 2007, now U.S. Pat. No. 7,632,149, which claims the benefit of U.S. Provisional Patent Application Nos. 60/817,857, filed Jun. 30, 2006, and 60/818,140 filed Jun. 30, 2006, all of which are incorporated by reference in their entireties.

This application is related to U.S. patent application Ser. No. 11/771,739 "Differential Pair Electrical Connector Having Crosstalk Shield Tabs," filed on Jun. 29, 2007, assigned to the same assignee and identifying Craig A. Bixler, John C. Laurx, Neil A. Martin and Tom Carlson as the inventors. This related application is incorporated by reference in its entirety as though fully set forth herein for everything it describes.

TECHNICAL FIELD

The present invention relates generally to electrical connectors, and more specifically, to high-frequency electrical connectors where signal crosstalk is a performance consideration.

BACKGROUND

Electronic devices continue to shrink in size, yet increase in speed and complexity. This has lead to the widespread availability of relatively small electronic components capable of driving high-speed signals (e.g., above one GHz) over printed circuit board (PCB) tracks. The increased use of these small, high-speed components has created a significant demand for high performance electrical connectors that can support high frequencies and denser PCB track configurations.

In response to this demand, certain types of high performance electrical connectors have been developed. One type of high performance connector is a GbX® Style connector, available from Molex, Inc. of Lisle, Ill. FIGS. 1-2 are partial top and bottom perspective views, respectively, of a conventional GbX® backplane connector 10.

The backplane connector 10 includes a non-conductive housing having a housing floor 12 with header sidewalls (not shown) extending perpendicularly from the housing floor 12 substantially parallel to each other. The partial views of FIGS. 1-2 show an exemplary 4×2 array of differential pins 13 and three ground plane shields 14 interposed between rows of differential pin pairs 11. Each of the pin pairs 11 can receive or transmit a differential signal. The differential-pair pins 13 and ground shields 14 are press-fitted into the floor 12 so as to pass through the floor 12. Each of the differential pins 13 has a generally flat upper portion 19 and an eye-of-the-needle compliant pin 23 as a lower portion. Each of the ground shields 14 has a generally flat upper blade 15 and one or more lower eye-of-the-needle pins 17.

For purposes of convention, the partial views of FIGS. 1-2 show two "columns" of differential pins 13. Each column has four metal differential pins 13, which are part of a larger column in the two-dimensional differential-pair pin array. Each ground shield 14 is made up of a metal plate 15 and is connected to ground to provide shielding between "rows" of the pin pairs 11.

Transmitting high speed signals over differential pair channels has become an increasingly popular technique for high bandwidth transmission between printed circuit boards (PCBs). In a typical high bandwidth system, "daughter card" PCBs are connected to a "backplane" using mated connectors. The backplane is itself a layered circuit board having, among other things, differential pair tracks formed therein for carrying high frequency signals between daughter cards.

In such systems, a variable that effects transmission bandwidth is crosstalk. Generally, crosstalk is the electrical interference in a channel caused by a signal traveling through a neighboring channel. Under some circumstances, the presence of unwanted crosstalk degrades system performance and negatively impacts bandwidth. Thus, in differential pair systems, it is important that daughter cards and backplanes are designed to reduce the amount of crosstalk between differential pairs. It is also highly desirable to have PCB connectors that reduce crosstalk.

In view of the foregoing, there is a substantial need for an electrical connector that significantly reduces crosstalk in high signal density, high bandwidth applications.

SUMMARY

It is an advantage of the present invention to provide an improved differential pair connector that includes means for significantly reducing crosstalk between differential pairs. It is a further advantage of the present invention to provide an improved connector that can be implemented with the mating and physical characteristics of a conventional connector type, such as a GbX® connector.

In accordance with an exemplary embodiment of the present invention, a differential pair connector has a housing floor, an array of differential pairs passing through the housing floor, and a conductive grid integrated into the housing floor for reducing crosstalk between the differential pairs. The conductive grid can have various structures, such as conductive inserts, plated regions and/or a conductive housing floor surrounding non-conductive inserts protecting the differential pins.

Other aspects, features, embodiments, processes and advantages of the invention will be or will become apparent to one with skill in the art upon examination of the following figures and detailed description. It is intended that all such additional features, embodiments, processes and advantages be included within this description, be within the scope of the invention, and be protected by the accompanying claims.

BRIEF DESCRIPTION OF THE DRAWINGS

It is to be understood that the drawings are solely for purpose of illustration and do not define the limits of the invention. Furthermore, the components in the figures are not necessarily to scale, emphasis instead being placed upon illustrating the principles of the invention. In the figures, like reference numerals designate corresponding parts throughout the different views.

DETAILED DESCRIPTION

The following detailed description, which references to and incorporates the drawings, describes and illustrates one or more specific embodiments of the invention. These embodiments, offered not to limit but only to exemplify and teach the invention, are shown and described in sufficient detail to enable those skilled in the art to practice the invention. Thus, where appropriate to avoid obscuring the invention, the description may omit certain information known to those of skill in the art.

Figure 3:
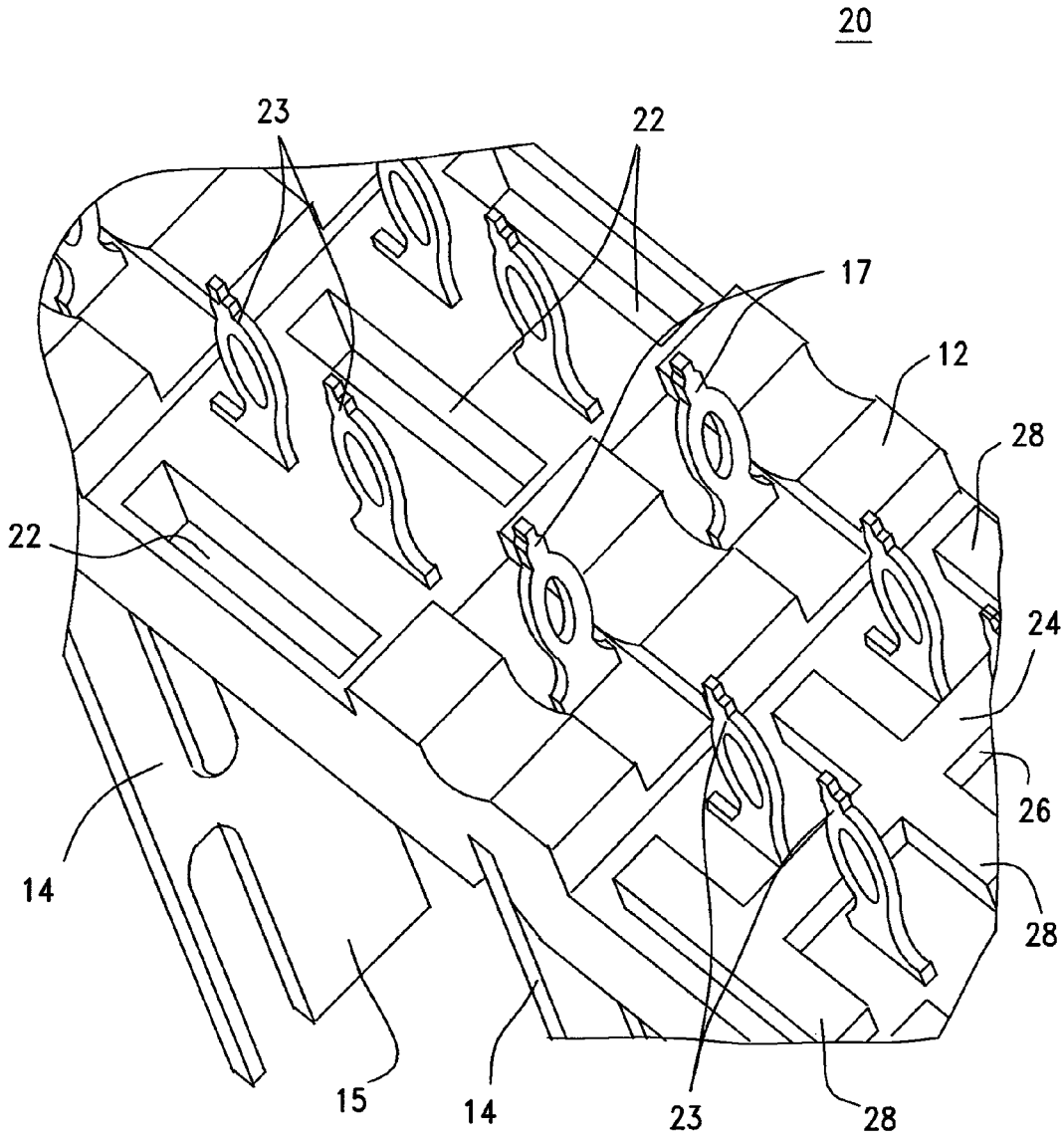
FIG. 3 is a bottom perspective view of a backplane connector in accordance with an exemplary embodiment of the present invention.

FIG. 3 is a bottom perspective view of a backplane connector 20 in accordance with an exemplary embodiment of the present invention. Although the invention is not limited to any particular type of electrical connector, the exemplary backplane connector 20 is preferably a GbX®-style connector having plural differential pair conductive pins 13 and ground planes 14 press fitted into a non-conductive housing floor 12. To reduce crosstalk between differential pairs 11, the connector 20 includes one or more electrically-conductive grids 22, 24 integrated into the housing floor 12 between the differential pairs 11. The grids 22, 24 are connected to ground or some other suitable common potential to provide additional electromagnetic shielding between differential pairs 11.

In the example shown, the conductive grids 22, 24 insert into the bottom of the housing floor 12. Preferably, the housing floor 12 includes hollow cores formed between differential pairs 11 adapted to frictionally receive at least part of the conductive grids 22, 24. The conductive grids 22, 24 extend into the thickness of the floor 12 between adjacent columns of differential pairs 11. This provides additional ground plane shielding around each differential pair 11, and when combined with the existing ground shields 14, the shielding extends in both dimensions of the differential pin array within the backplane housing floor 12. This additional shielding significantly reduces crosstalk between differential pairs 13.

FIG. 3 illustrates two different types of conductive grids 22, 24. The first type of grid 22 includes individual conductive wedges (e.g., conductive wedges 31 of FIG. 4 or conductive wedges 42 of FIG. 5) that are inserted into the housing floor 12 between adjacent columns of differential pairs 11. The second type of grid 24 includes wedges 28 inserted into the floor 12 between adjacent columns of differential pairs 11 and a conductive spine 26 connecting the wedges 28. The spine 26 extends between pins 23 in a row of differential pairs 13. The wedges 28 form a plurality of conductive ribs extending perpendicularly from the spine 26 between adjacent columns of the differential pairs 11. The wedges in either type of grid 22, 24 can be the conductive wedges 31 of FIG. 4, conductive wedges 42 of FIG. 5 or any other conductive element of suitable shape and size.

The conductive grids 22,24 can be made of any suitable conductive material, such as an injection molded conductive plastic, metal such as a die cast part, plated metal such as nickel over copper, plated plastic or the like. Any suitable number of conductive grids can be integrated into the backplane housing 12.

The backplane connector housing 12 can be made of any suitable electrically non-conductive material, and is preferably made of a thermoplastic formed using conventional injection molding techniques.

Figure 4:
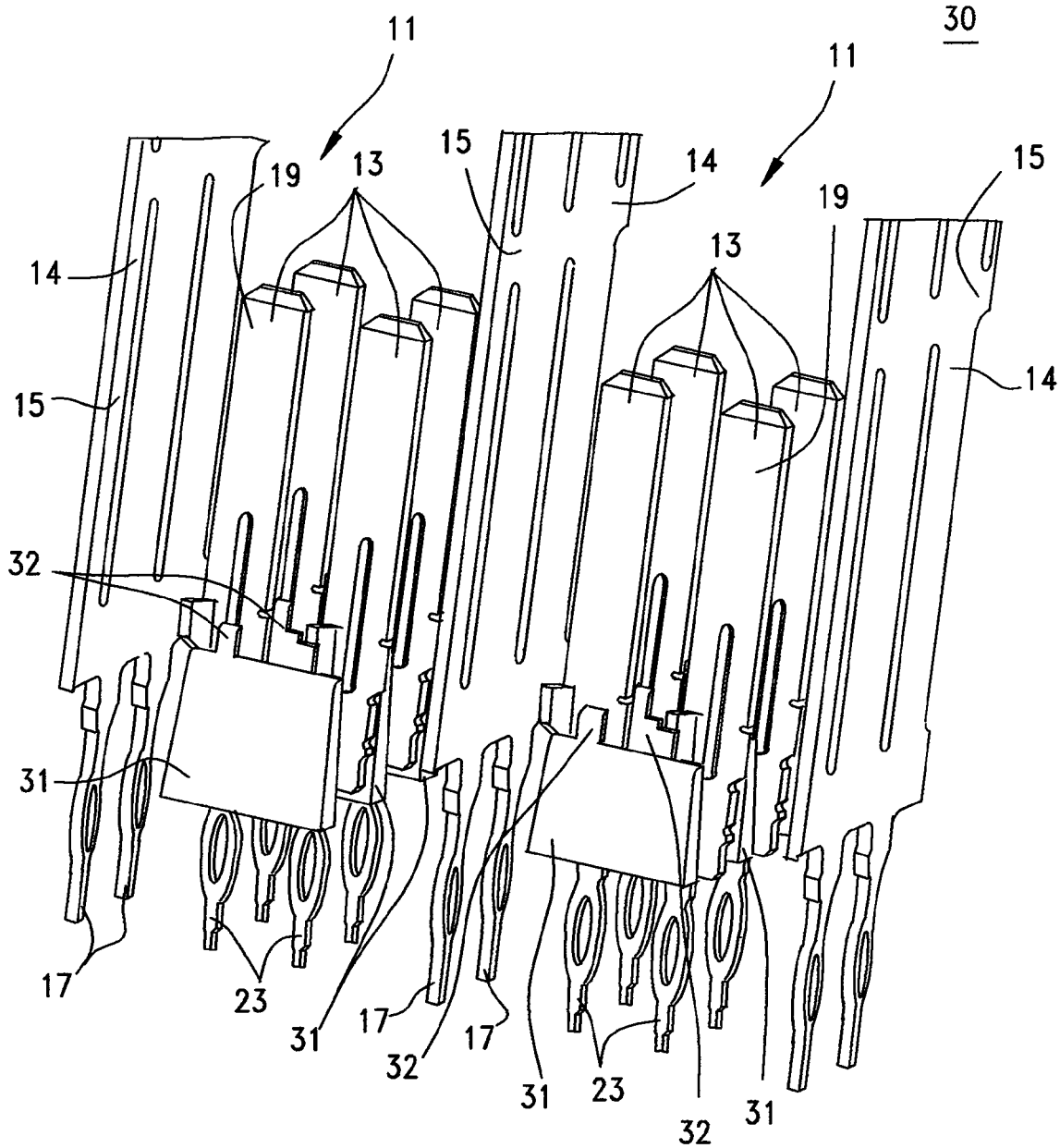
FIG. 4 is a skeletal perspective view of a backplane connector including a first style of crosstalk shielding wedges.

FIG. 4 is a skeletal perspective view of a backplane connector 30 showing a first style of conductive wedges 31. In this view, the backplane housing is omitted to more clearly show the arrangement of the conductive grid wedges 31, differential pins 13 and ground planes 14. Each of the wedges 31 has one or more conductive pipes 32 extending from their tops. The conductive pipes 32 are embedded in the housing floor 12 and provide crosstalk shielding using less conductive material than the solid wedges 42 shown in FIG. 5.

Figure 5:
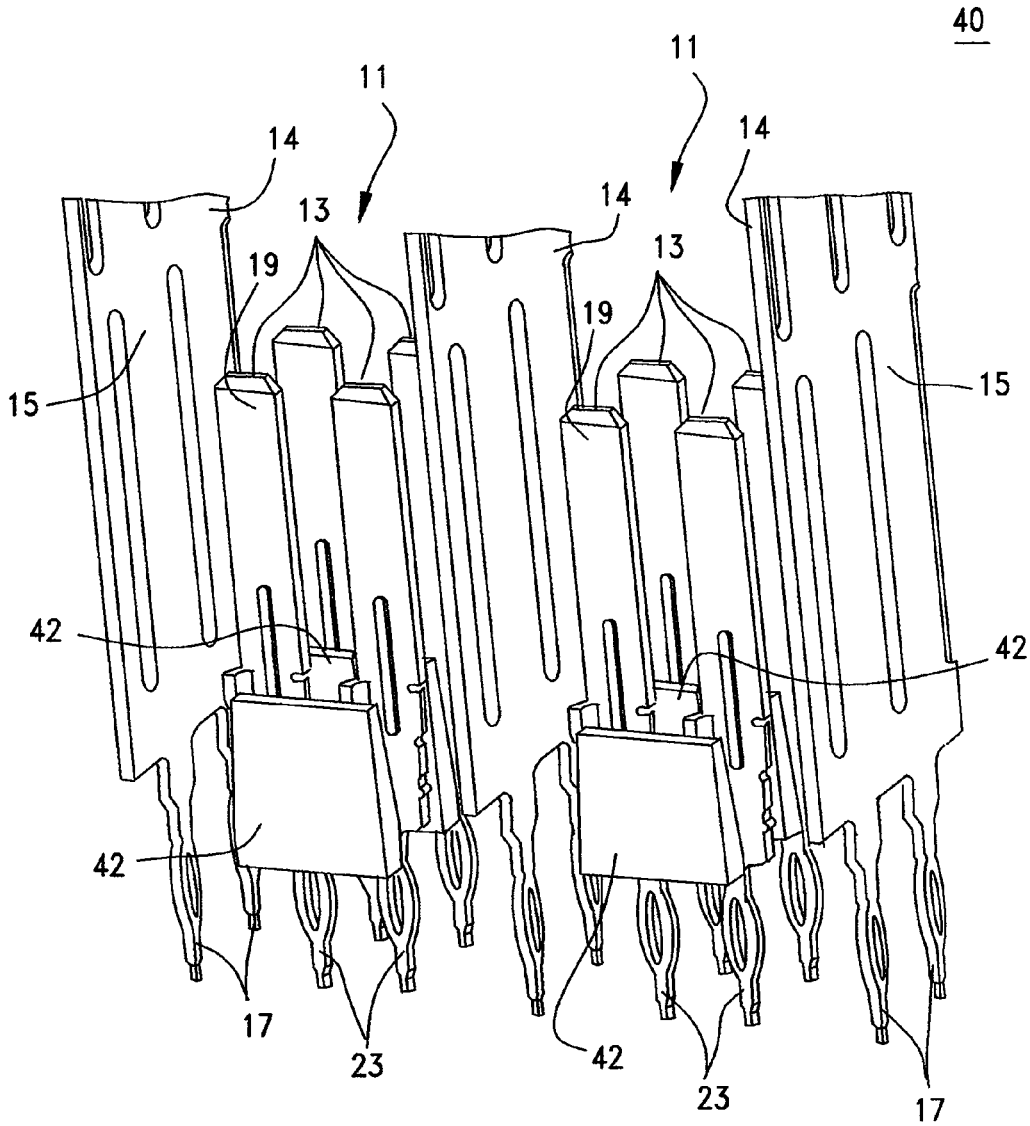
FIG. 5 is a skeletal perspective view of a backplane connector having a second style of crosstalk shielding wedges.

FIG. 5 is a skeletal perspective view of a backplane connector 40 with a second style of crosstalk shielding wedges 42. In this view, the backplane housing is omitted to more clearly show the arrangement of the conductive grid wedges 42, differential pins 13 and ground planes 14. The alternative conductive wedges 42 are solid, and do not include conductive pipes. Instead, the solid portion of the wedges 42 extends through the thickness of the housing floor 12.

Conductive wedges 31, 42 have a predefined height, which defines how much of the wedge extends into the housing floor 12. The height is selected to provide a desired amount of crosstalk reduction. The height may be greater than or equal to the entire thickness of the housing floor 12, or some lesser amount.

Figure 1:
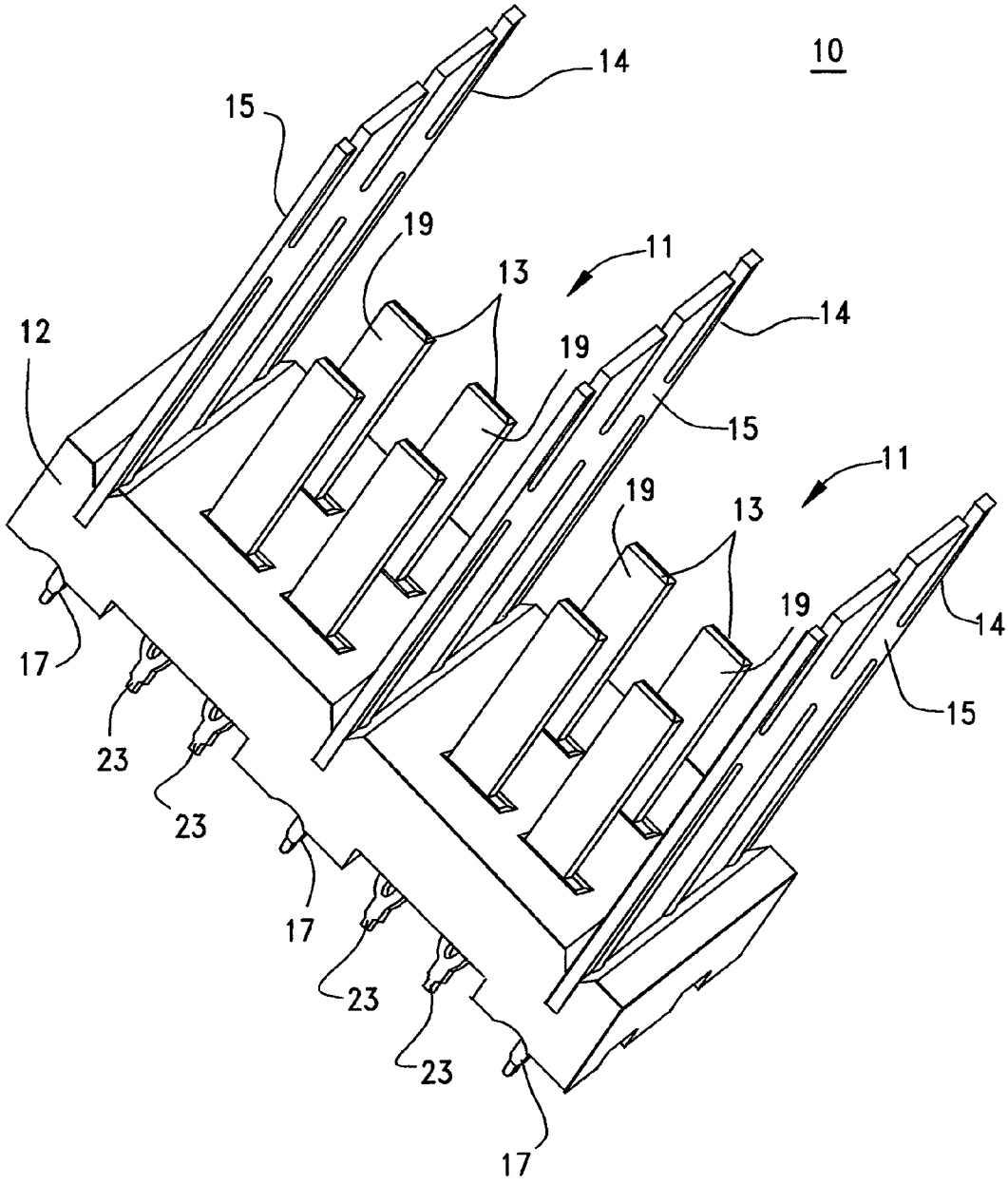
FIG.1 (PRIOR ART)
FIG. 1 is a top perspective view of a prior art backplane connector.
Figure 2:
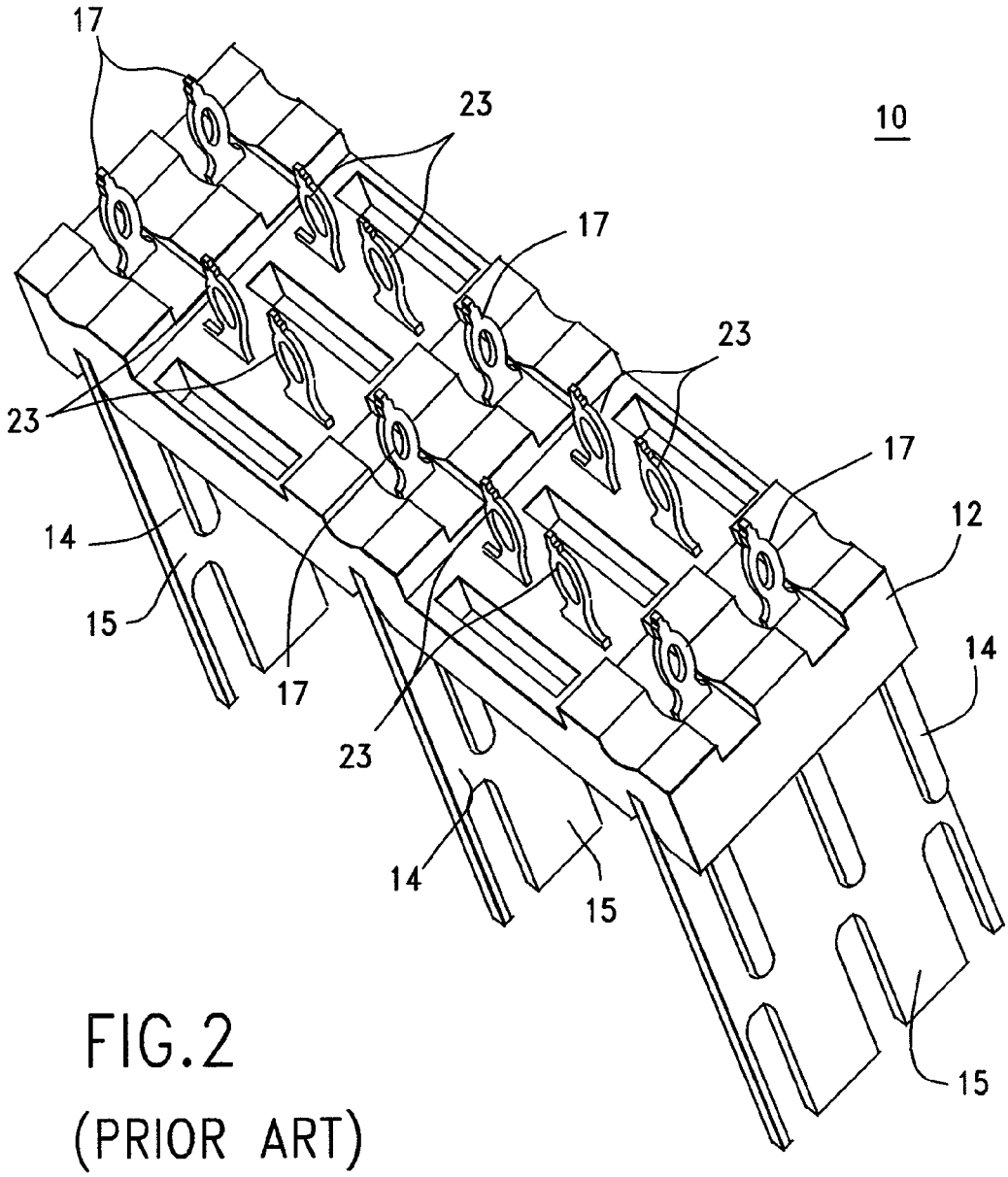
FIG.2 (PRIOR ART)
FIG. 2 is a bottom perspective view of the prior art backplane connector shown in FIG. 1.
Figure 6:
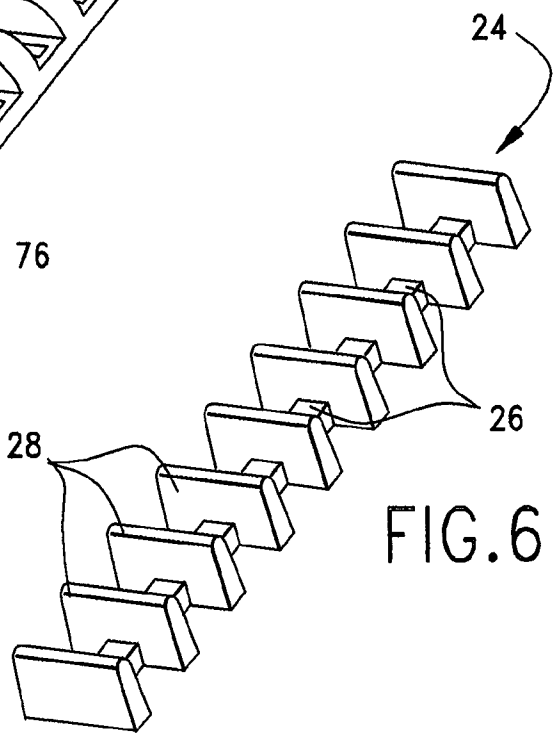
FIG. 6 is a perspective view of one of the crosstalk reduction grids shown in FIG. 1.

FIG. 6 is a perspective view of the second type of crosstalk reduction grid 24 shown previously in FIG. 1.

Figure 7:
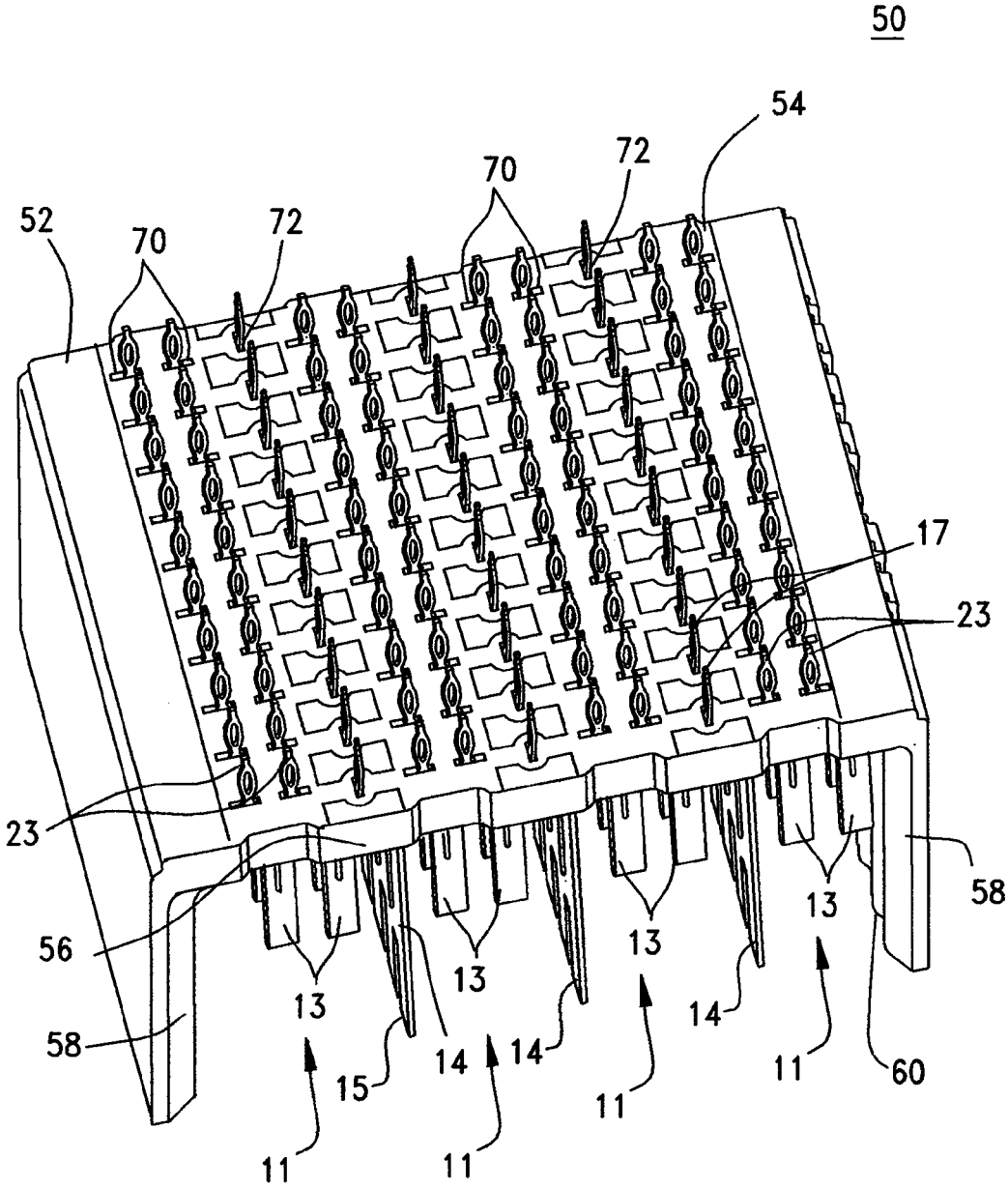
FIG. 7 is a bottom perspective view of a backplane connector in accordance with a further embodiment of the present invention.

FIG. 7 is a bottom perspective view of a backplane connector 50 in accordance with a further exemplary embodiment of the present invention. The backplane connector 50 is a GbX® style module having an 8×10 array of differential pins 13 and three ground plane shields 14 interposed between rows of differential pin pairs 11. For the sake of clarity, only the first column of pin pairs 13 and only the first two rows of ground shield pins 17 are shown in FIG. 7, while the remainder of the pins are omitted from the view.

The connector 50 includes a non-conductive housing 52 and a conductive crosstalk shielding panel 54 integrated into the housing floor 56. Although any suitable means can be used to fasten the panel 54 into the housing floor 56, the shielding panel 54 is preferably press fitted into the bottom of the housing floor 56. Preferably, the bottom of the housing floor 56 includes hollow contours formed therein to snuggly receive at least part of the panel 54. Adhesives can also be used to attach the panel 54 to the housing floor 56.

The connector housing 52 includes sidewalls 58 extending from the housing floor 56 substantially parallel to each other. The housing sidewalls 58 have guide slots 60 formed on their inside faces for receiving daughter card connector edge guides.

The conductive panel 54 has an array of thru-hole openings 70 sized and positioned to receive the differential pairs 13, while keeping the panel 54 electrically isolated from the differential pair conductors 13. The conductive panel 54 also includes one or more thru-hole openings 72 sized and shaped for receiving the ground plane conductor pins 17 and establishing electrical contact between the panel 54 and the ground plane shields 14. Thru-holes openings corresponding to the conductive panel openings 70, 72 are formed in the housing floor 56.

To assemble the connector 50, the conductive panel 54 is first press fitted into the bottom of the housing floor 56. The differential-pair pins 13 and ground shields 14 are then press fitted into the floor 56 from the top side so as to pass through the floor 12 and panel openings 70, 72.

Figure 8:
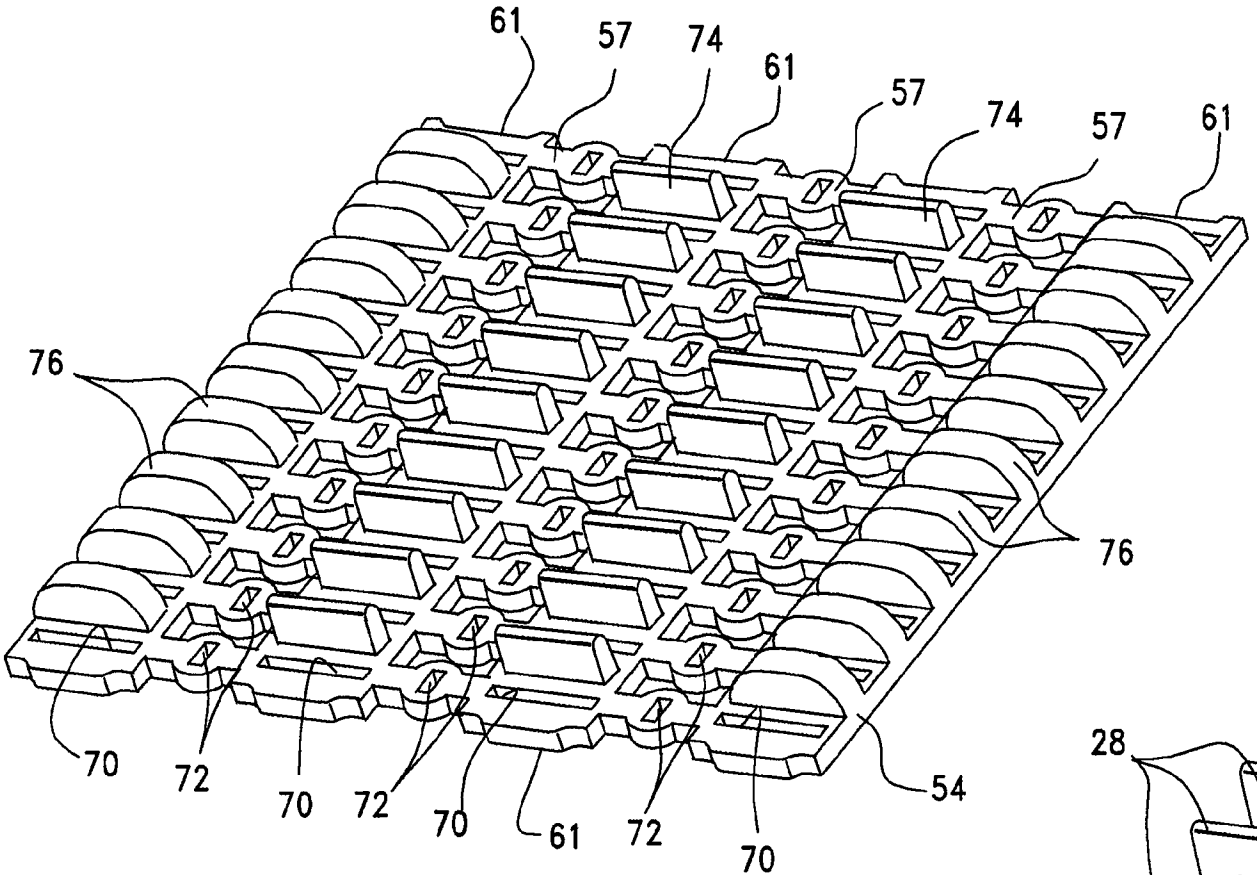
FIG. 8 is a top perspective view of the crosstalk reduction panel shown in FIG. 7.

FIG. 8 is a top perspective view of the conductive crosstalk reduction panel 54 shown in FIG. 7. The panel 54 includes an array of conductive ribs 74, 76 extending upwardly from the panel 54 and spaced apart from each other so as to insert into the housing floor 56 between adjacent columns of differential pairs 13. The ribs 74, 76 extend into the housing floor 56 to provide additional crosstalk shielding. The ribs 74, 76 are arranged in four rows 61. Adjacent rows 61 are connected together by plural eyelets 57, each eyelet 57 corresponding to a respective ground shield pin 17. The outer ribs 76 are thicker than the inner ribs 74.

The ribs 74, 76 have a predefined height, which defines how far the ribs extends into the housing floor 56. The height is selected to provide a desired amount of crosstalk reduction. The height may be greater than or equal to the entire thickness of the housing floor 56, or some lesser amount.

The conductive panel 54 can be made of any suitable electrically conductive material such as die cast or stamped metal, a molded conductive polymer, plated plastic or the like.

The backplane connector housing 52 can be made of any suitable electrically non-conductive material, and is preferably made of a thermoplastic formed using conventional injection molding techniques.

Figure 9:
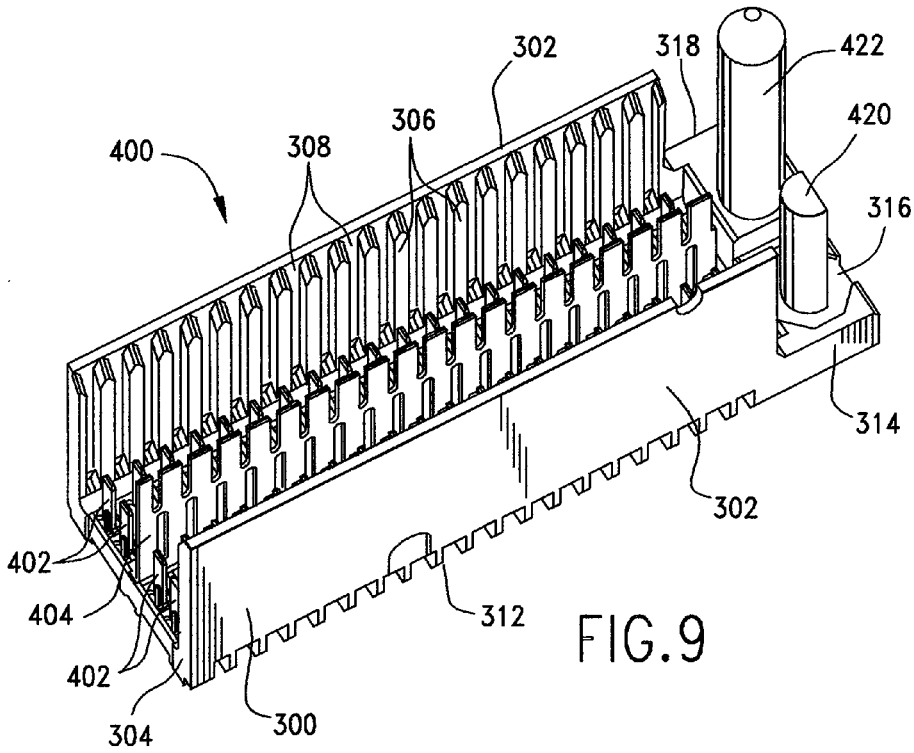
FIG. 9 is a perspective view of a GbX®-style backplane connector in accordance with a preferred embodiment of the present invention.

FIG. 9 is a perspective view of a GbX®-style backplane connector 400 in accordance with a preferred embodiment of the present invention. The exemplary backplane connector 400 is a GbX®-style module having an 4×20 array of differential pins 402 and a ground plane shield 404 interposed between the two rows of differential pin pairs. The connector 400 includes a non-conductive housing 300 and a conductive crosstalk shielding grid 201 (see FIGS. 10 and 11A-B) integrated into the housing floor 304. The conductive grid 201 extends into the thickness of the floor 304 between adjacent columns of differential phi pairs 402 and makes contact with the ground plane shield 404. This provides additional ground plane shielding around each differential pair, and when combined with the existing ground shields 404, the shielding extends in both dimensions of the differential pin array within the backplane housing floor 304. This additional shielding significantly reduces crosstalk between differential pairs.

In the embodiment shown, the conductive grid 201 has twenty rows of ribs, each row having two opposing ribs. The grid 201 is a two-piece construction that includes two of the twenty-rib conductive grids 200 (see FIGS. 16A-19) inserted into the housing floor 304 in a head-to-toe arrangement.

Although any suitable means can be used to fasten the conductive grid 201 into the housing floor 304, the grid 201 is preferably press fitted into the top of the housing floor 304. During assembly, the grid 201 is fitted into the housing 300 prior to insertion of the differential pins 402 and ground plane shielding 404. The grid 201 includes protrusions 214 and 210 (see FIGS. 17 and 19) to improve the frictional contact between itself and walls formed in the connector housing floor 304. Adhesives could also be used to attach the grid 200 to the housing 300.

The connector housing 300 includes sidewalls 302 extending from the housing floor 304 substantially parallel to each other. The housing sidewalls 302 have guide slots 308 formed on their inside faces for receiving daughter card connector edge guides. Inwardly protruding ribs 306 are regularly spaced along the inside faces of the sidewalls 302 to form the guide slots 308. Regularly-spaced exterior fins 312 are formed along the lower edge of each sidewall 302.

The connector 400 includes an end portion 314 of the housing 300 upon which are mounted a guide pin 422 and keying pin 420. The guide pin 422 and keying pin 420 have the same functions and characteristics of those found on conventional GbX® connectors. The guide pin 422 is mounted on a raised platform 318 and the key is mounted on a lower platform 316. Generally, the guide pin 422 and keying pin 420 are received in mated recepticals of a corresponding GbX® daughter card connector in order to ensure a properly aligned connection, i.e., to reduce the risk of a misaligned or reversed connection. The keying pin 420 is a half cylinder that can be rotated into one of eight different orientations denoted by letters A-H, or removed, giving a total of nine different setting. A keyhole on a corresponding daughter card connector ensures that only a matching daughter card can be connected to the backplane connector 400.

Figure 10:
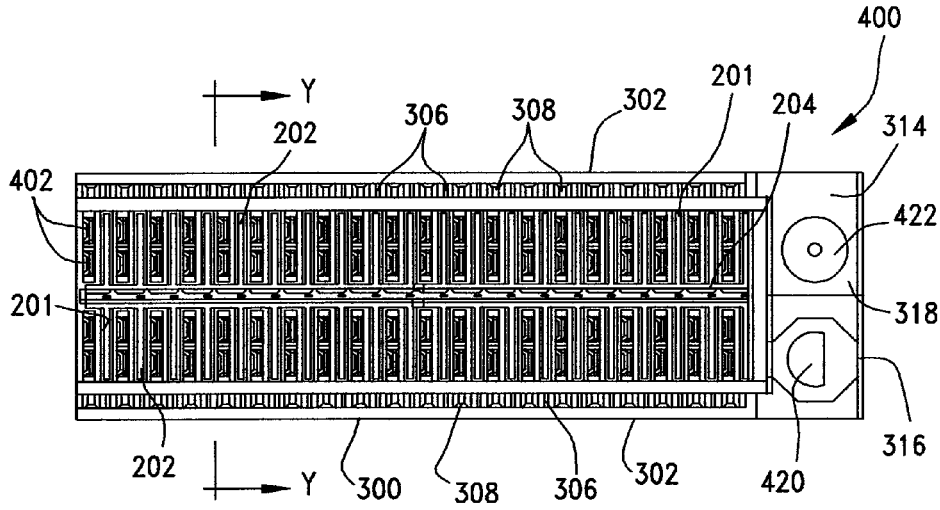
FIG. 10 is a top plan view of the GbX®-style backplane connector shown in FIG. 9.

FIG. 10 is a top plan view of the backplane connector 400 shown in FIG. 9. The conductive grid 200 is inserted into the housing floor 304 so that it is flush with the top of the floor 304 to avoid interfering with the mated characteristics of the backplane connector 400.

Figure 11B:
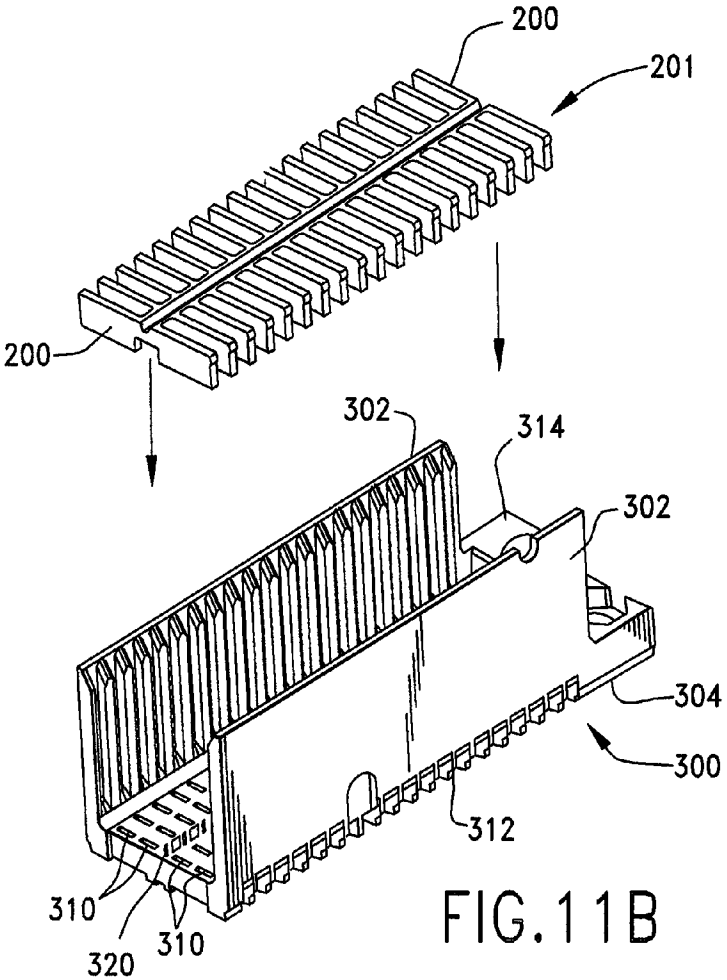
FIGS. 11A-B show front and back perspective views, respectively, of the backplane connector housing of the connector shown in FIGS. 9-10, omitting differential pins, guide pins and ground shields.
Figure 11A:
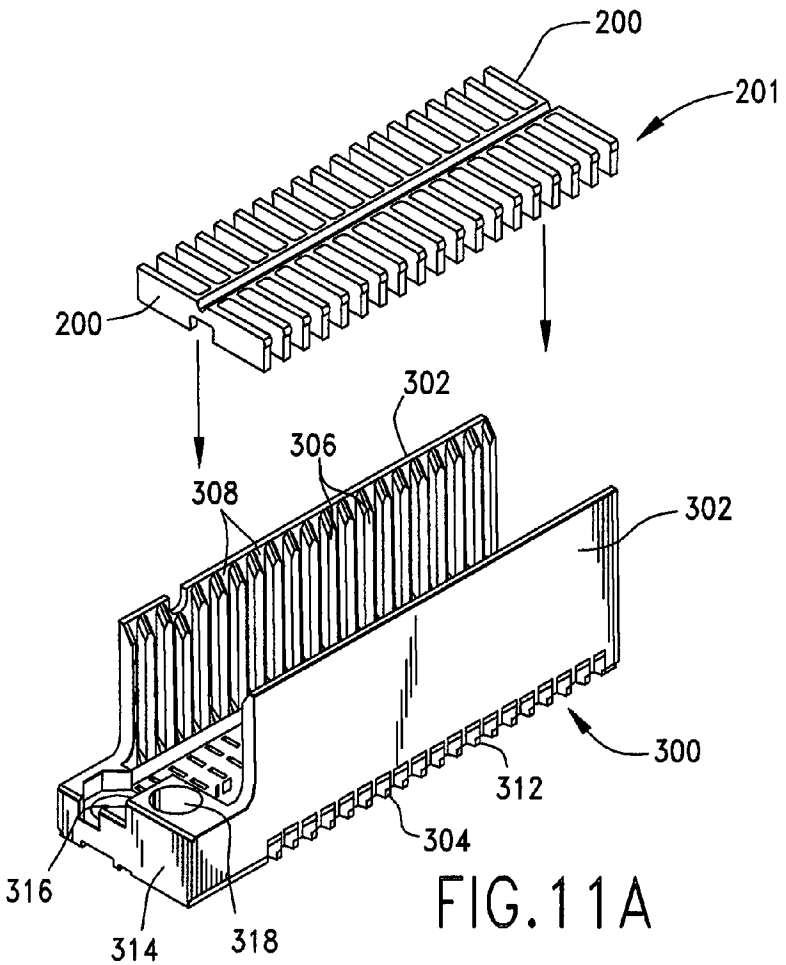

FIGS. 11A-B show front and back perspective views, respectively, of the backplane connector housing 300 of the connector 400 shown in FIGS. 9-10, without differential pins 402, guide pins 420-422 and ground shield 404, and with the conductive grid 201 removed. The conductive grid comprises two of the twenty-rib grids 200 shown in FIGS. 16A-19.

The backplane connector housing 300 can be made of any suitable electrically non-conductive material, and is preferably made of a thermoplastic formed using conventional injection molding techniques.

Figure 12:
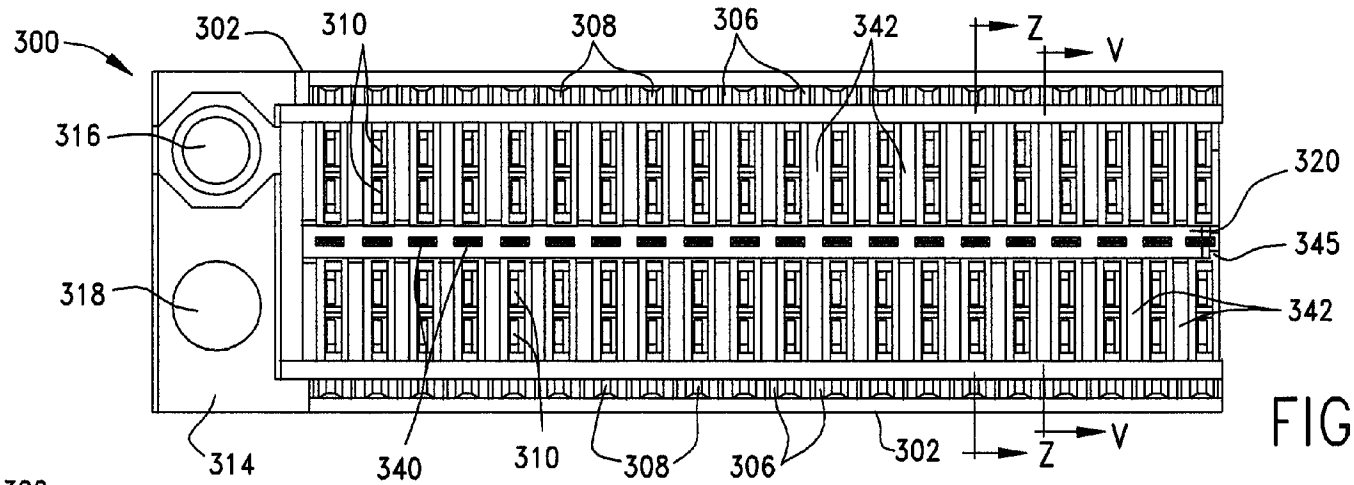
FIG. 12 is a top plan view of the GbX®-style backplane connector housing shown in FIGS. 11A-B.

FIG. 12 is a top plan view of the GbX®-style backplane connector housing 300 shown in FIGS. 11A-B. The housing floor 304 has formed therein a 4×20 array of thru-hole slots 310 adapted to frictionally receive the differential pins 402. A central trough 320 and lateral thru-hole slots 342 are also formed in the floor and adapted to receive the conductive grid 201. The trough 342 receives the spine 204 (see FIGS. 16*a*-19) of the grid 201 and the lateral thru-hole slots 342 receive the ribs 202 (see FIGS. 16*a*-19) of the grid 201. In the bottom of the trough 320 are thru-hole slots 340 aligned along the central axis of the housing 300. The thru-hole slots 340 are sized and positioned to frictionally receive the lower pins 430 (see FIG. 20) of the ground plane shield 404.

Figure 13:
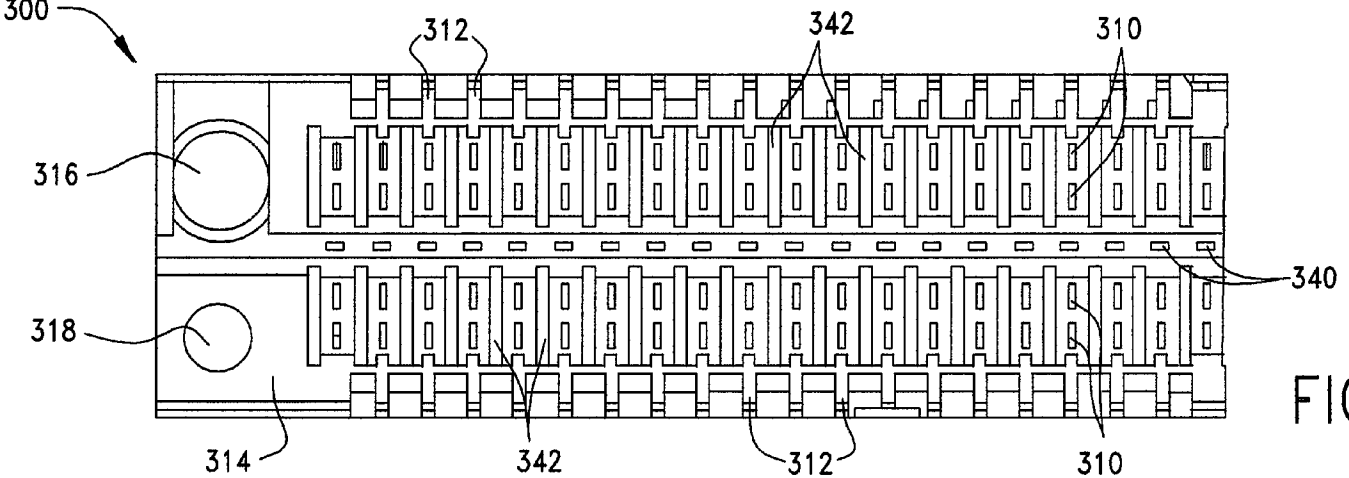
FIG. 13 is a bottom plan view of the GbX®-style backplane connector housing shown in FIGS. 11A-B.

FIG. 13 is a bottom plan view of the GbX®-style backplane connector housing 300 shown in FIGS. 11A-B. The thru-hole slots 310, 340, 342 allow the differential pins 402, ground plane pins 430, and conductive grid ribs 202, respectively, to pass through the entire thickness of the housing floor 304.

Figure 14:
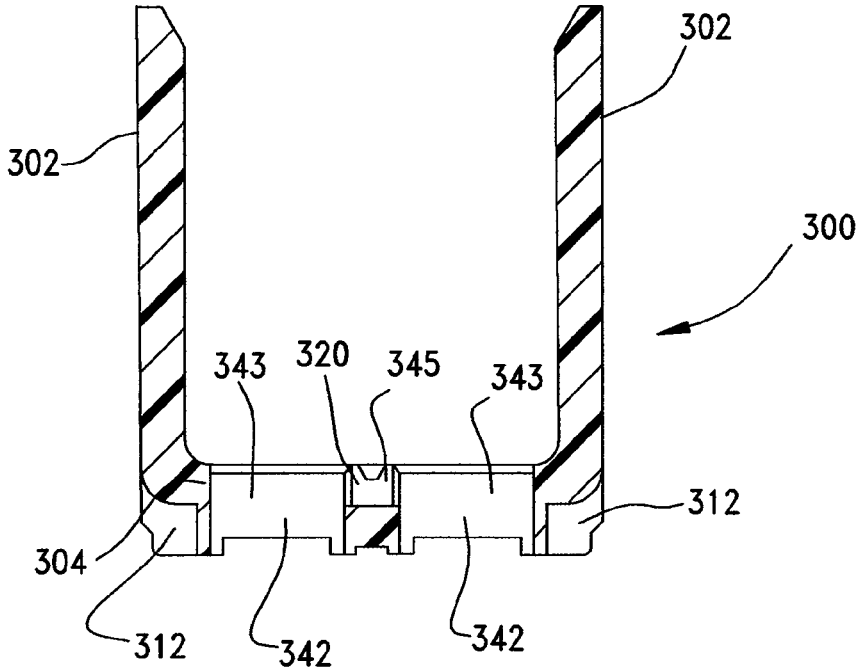
FIG. 14 is a first cross-sectional view of the GbX®-style backplane connector housing along section V-V of FIG. 12.

FIG. 14 is a first cross-sectional view of the GbX®-style backplane connector housing 300 along section V-V of FIG. 12. This view shows the lateral interior walls 343 of the lateral thru-hole slots 342 and the notched end wall 345 of the center trough 320.

Figure 15:
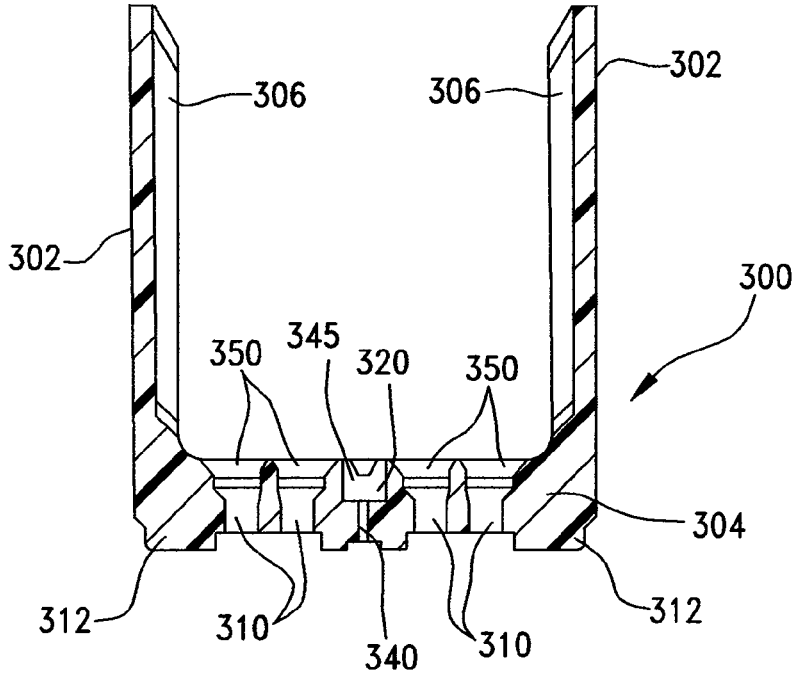
FIG. 15 is a second cross-sectional view of the GbX®-style backplane connector housing along section Z-Z of FIG. 12.
Figure 16A:
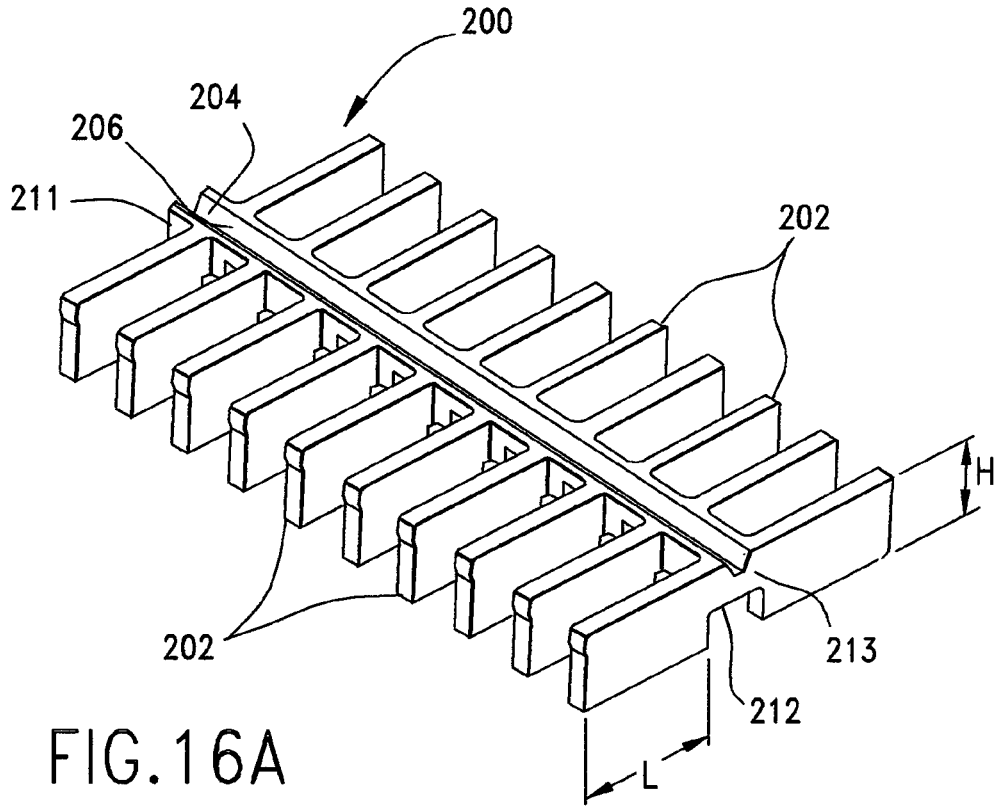
FIGS. 16A-B are perspective views of the crosstalk reduction grid included in the backplane connector shown in FIGS. 9-10.
Figure 16B:
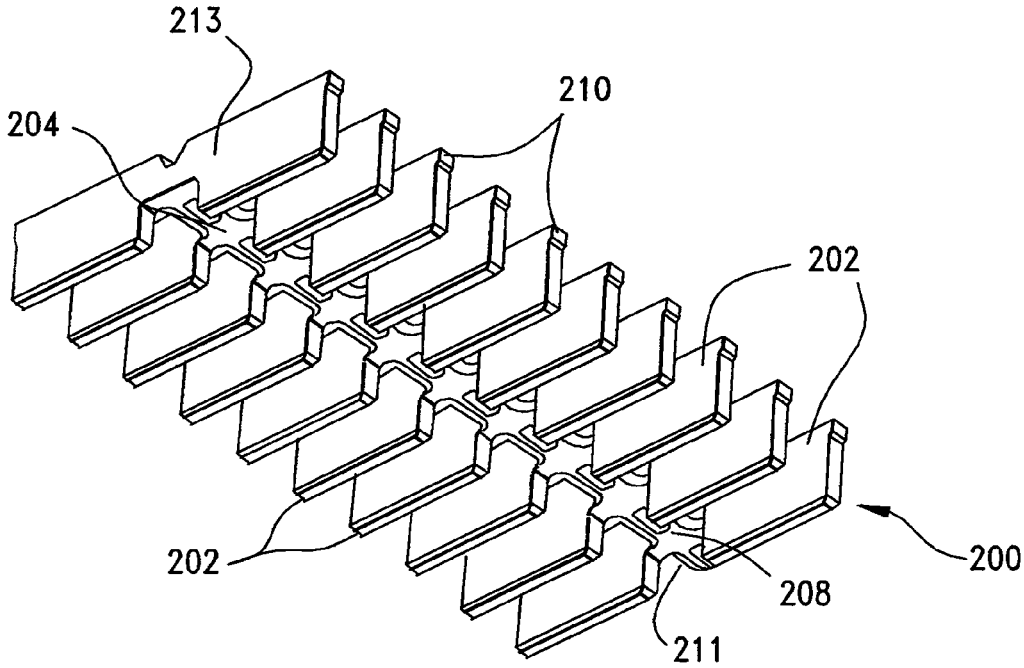

FIG. 15 is a second cross-sectional view of the GbX®-style backplane connector housing 300 along section Z-Z of FIG. 12. This view shows details of the differential pins thru-hole slots 310. Each slot 310 includes a tapered upper opening 350 that necks down to a smaller opening that exits at the bottom of the housing floor 304. This slot configuration provides improved seating of the differential pins 402 when they are inserted into the slots 310.

Figure 17:
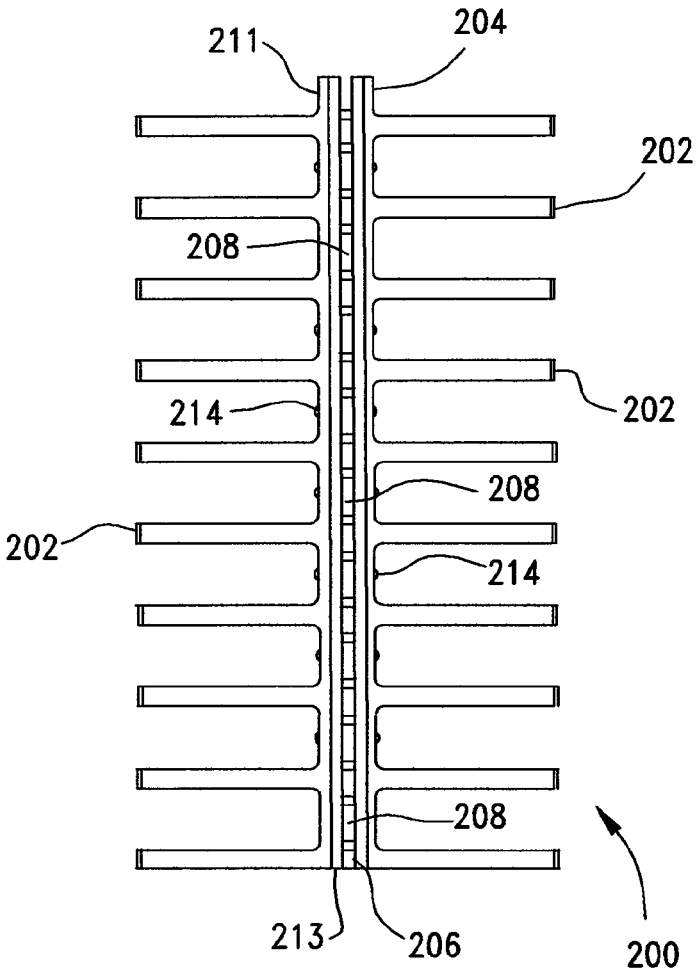
FIGS. 17-19 are various views of the crosstalk reduction grid of FIGS. 16A-B.
Figure 18:
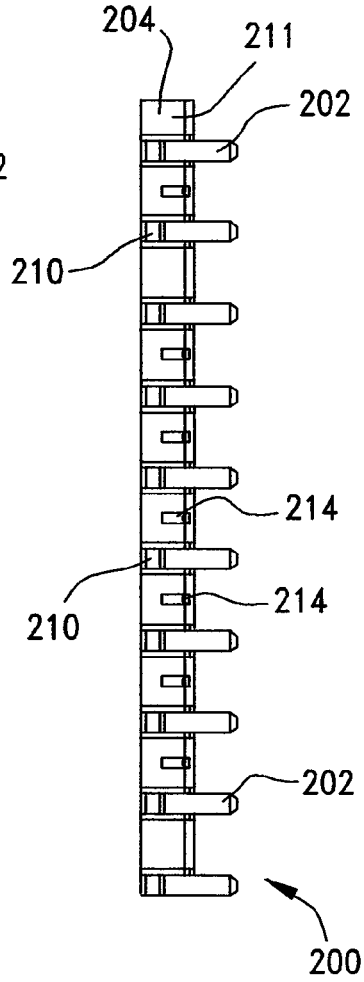
Figure 19:
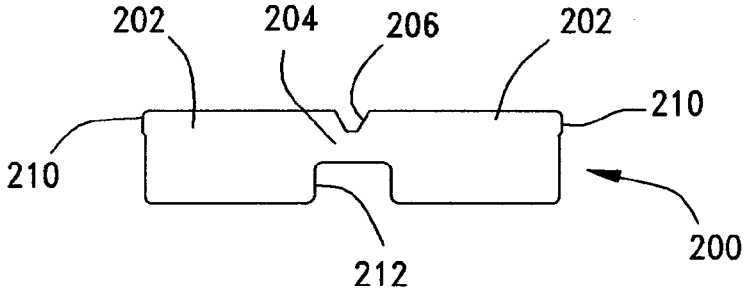

FIGS. 16 A-B are perspective views of the twenty-rib conductive crosstalk reduction grid 200 included in the backplane connector 400 shown in FIGS. 9-10. FIGS. 17-19 are certain further views of the crosstalk reduction grid 200.

The grid 200 includes a central spine 204 and twenty conductive ribs 202 extending perpendicularly from either side of the spine 204 in an opposing manner, forming ten rows of regularly spaced ribs. A central notch 212 defines a gap between the ribs 202 of each row, as well as the bottom of the spine 204. The height, h, of the ribs 202 is about or equal to the thickness of the housing floor 304. The length, l, of each rib 202 is typically sufficient to cover the horizontal width of two side-by-side differential pins 402.

One end 213 of the spine 204 terminates flush with an end pair of ribs. The other end 211 of the spine extends beyond the other end pair of ribs.

A central trough 206 is formed in the top of the spine 204. A plurality of thru-hole slots 208 are formed along the center of the trough 206 (see FIGS. 16B and 17). The slots 208 and the trough are adapted to receive the ground plane shield 404 such that electrical contact is made between the grid 200 and the shield when the connector 400 is assembled.

The grid 200 also includes means for frictionally engaging the connector housing 300 when it is inserted into the housing floor 304. These means include bumps 210 protruding from the ends of each of the ribs 202 and bumps 214 protruding from the spine 204. Slight protrusions can be formed elsewhere on the grid 200 to frictionally engage the housing 300. Slight indentations can be formed in the housing openings and channels to receive the protrusions. The corresponding indentations permit the grid 200 to be snap-fitted into place within the housing floor 304.

The conductive grid 200 is preferably made of an injection-molded conductive polymer, but can also be made of any suitable electrically conductive material such as die cast or stamped metal, plated plastic or the like.

Figure 20:
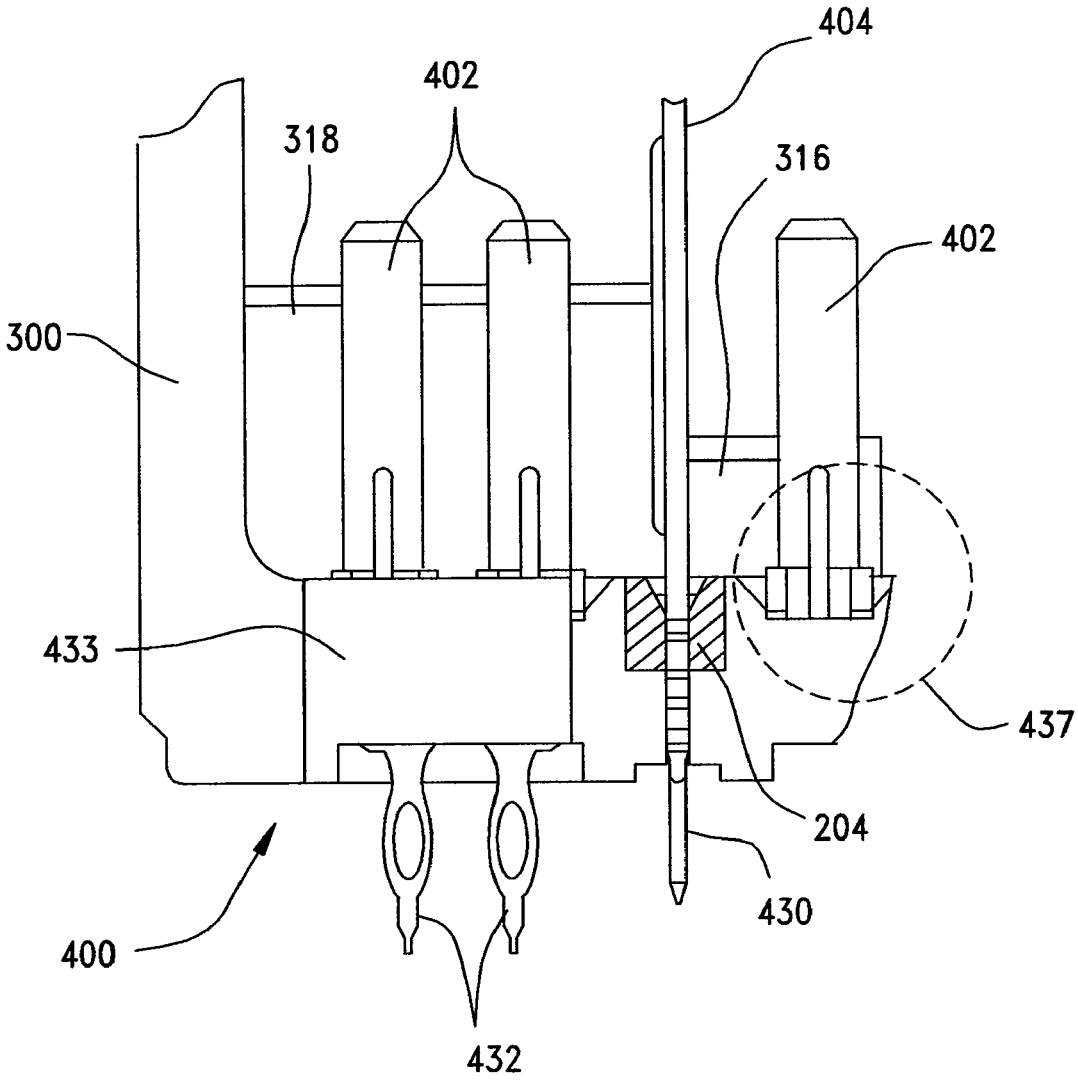
FIG. 20 is a partial cross-sectional view of the GbX®-style backplane connector along section Y-Y of FIG. 10.

FIG. 20 is a partial cross-sectional view of the GbX®-style backplane connector 400 along section Y-Y of FIG. 10. This view shows the non-conductive wall 433 formed in the housing floor 304 to separate the differential pins 402 from the ribs 202 of the conductive grid 201. Detail 437 is a partial cutaway view of the wall 433, which reveals the upper taper of the slots 310 and differential pin 402 seating within the slots 310.

The preceding detailed description has illustrated the principles of the invention using specific implementations of differential pair connectors. However, the invention is not limited to these particular implementations. For example, the inventive principles disclosed herein can be implemented in many other types of connectors, such as non GbX®-style connectors. It should be further understood that the connectors disclosed herein could be configured to contain any suitable number of differential pins and ground planes, or any suitably sized pin array, without departure from the principles of the invention.

Therefore, while one or more specific embodiments of the invention have been described, it will be apparent to those of ordinary skill in the art that many more embodiments are possible that are within the scope of this invention. Further, the foregoing detailed description and drawings are considered as illustrative only of the principles of the invention. Since other modifications and changes may be or become apparent to those skilled in the art, the invention is not limited the exact construction and operation shown and described, and accordingly, all suitable modifications and equivalents are deemed to fall within the scope of the invention.

We claim:

1. A connector, comprising:

a housing having a floor with a plurality of slots and a first and second sidewall extending from the floor in a first direction, one of the first and second sidewall having guide grooves;

a plurality of signal pins positioned in a first portion of the plurality of slots, the signal pins forming a plurality of differential pairs;

a plurality of ground pins positioned in a second portion of the plurality of slots; and a conductive grid pressed into the floor, the conductive grid in electrical communication with the ground pins and configured to provide electrical separation between the plurality of differential pairs.

2. The connector of claim 1, wherein one of the ground pins and the conductive grid provides electrical separation on at least three sides of one of the plurality of differential pairs.

3. The connector of claim 1, wherein the conductive grid includes a spine and a plurality of ribs extending from the spine.

4. The connector of claim 3, wherein the plurality of ribs extend from the spine in a perpendicular orientation.

5. The connector of claim 3, wherein the plurality of ribs extend from opposite sides of the spine.

6. The connector of claim 5, wherein the plurality of ribs on the opposite sides of the spine are orientated in a substantially parallel orientation.

7. The connector of claim 5, wherein the plurality of ribs and the conductive spine form three-sided structures on opposite sides of the spine.

8. The connector of claim 1, wherein the floor has a thickness and at least a portion of the grid extends the thickness of the floor.

9. The connector of claim 1, wherein the conductive grid is form of a material selected from the group consisting of a conductive plastic and a plated plastic.

* * * * *